US008400342B2

(12) United States Patent
Zimmerman et al.

(10) Patent No.: US 8,400,342 B2
(45) Date of Patent: Mar. 19, 2013

(54) EXPLOSION PROOF ELECTRO-MECHANICAL JOYSTICK

(75) Inventors: Joseph J. Zimmerman, Franklin, PA (US); Garrett L. Lowman, Polk, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 710 days.

(21) Appl. No.: 12/560,385

(22) Filed: Sep. 15, 2009

(65) Prior Publication Data

US 2011/0063139 A1 Mar. 17, 2011

(51) Int. Cl.
*G09G 5/08* (2006.01)

(52) U.S. Cl. ..... 341/161; 341/20; 345/157; 345/168; 200/4; 200/5 R; 200/5 A; 200/6; 338/72; 338/74; 338/68; 338/118

(58) Field of Classification Search ..... 341/20–23; 345/157, 168, 161; 200/4, 5 R, 5 A, 18, 533, 200/553, 557, 517, 6 A, 612; 338/118, 162, 338/68, 72, 74, 160
See application file for complete search history.

(56) References Cited

U.S. PATENT DOCUMENTS

| | | | | | |
|---|---|---|---|---|---|
| 2,747,035 | A | | 5/1956 | Hansen et al. | |
| 2,762,234 | A | | 9/1956 | Dodd | |
| 2,929,258 | A | * | 3/1960 | Mackway | 74/471 R |
| 3,164,838 | A | | 1/1965 | Heinrich | |
| 3,308,675 | A | | 3/1967 | Jonsson | |
| 3,323,386 | A | | 6/1967 | Musick et al. | |
| 3,870,986 | A | | 3/1975 | Oka et al. | |
| 4,093,953 | A | | 6/1978 | Hammons et al. | |
| 4,161,726 | A | | 7/1979 | Burson et al. | |
| 4,439,649 | A | * | 3/1984 | Cecchi | 200/6 A |
| 4,479,038 | A | * | 10/1984 | Marhold et al. | 200/6 A |
| 4,531,027 | A | * | 7/1985 | Vogt et al. | 200/6 A |
| 4,689,449 | A | | 8/1987 | Rosen | |
| 4,767,901 | A | | 8/1988 | Goyarts | |
| 4,812,829 | A | * | 3/1989 | Ebina et al. | 345/159 |
| 5,491,462 | A | * | 2/1996 | Cecchi et al. | 338/128 |
| 5,561,883 | A | | 10/1996 | Landry et al. | |
| 5,655,411 | A | | 8/1997 | Avitan et al. | |
| 6,059,660 | A | * | 5/2000 | Takada et al. | 463/38 |
| 6,064,369 | A | * | 5/2000 | Okabe et al. | 345/161 |
| 6,198,054 | B1 | | 3/2001 | Janniere | |
| 6,208,328 | B1 | * | 3/2001 | Kawachiya et al. | 345/157 |
| 6,362,810 | B1 | * | 3/2002 | Matsuda | 345/161 |
| 6,427,441 | B2 | | 8/2002 | Wustefeld et al. | |
| 6,618,036 | B1 | * | 9/2003 | Tanaka | 345/161 |
| 6,654,005 | B2 | * | 11/2003 | Wang | 345/161 |
| 7,053,568 | B2 | | 5/2006 | Rudinec | |
| 7,256,679 | B2 | | 8/2007 | Arai et al. | |
| 2001/0011630 | A1 | * | 8/2001 | Loschner et al. | 200/6 A |
| 2001/0025488 | A1 | | 10/2001 | Wustefeld et al. | |
| 2003/0090225 | A1 | | 5/2003 | Posma et al. | |
| 2006/0050056 | A1 | * | 3/2006 | Armstrong | 345/161 |
| 2006/0061309 | A1 | | 3/2006 | Rudinec | |
| 2007/0082735 | A1 | * | 4/2007 | Bell | 463/38 |
| 2007/0177010 | A1 | | 8/2007 | Murata | |
| 2007/0230075 | A1 | | 10/2007 | Murata et al. | |
| 2008/0172146 | A1 | | 7/2008 | Lin | |

* cited by examiner

*Primary Examiner* — Linh Nguyen
(74) *Attorney, Agent, or Firm* — Michael Best & Friedrich LLP

(57) ABSTRACT

A joystick comprising a housing, a ball supported and held within the housing, and a joystick handle attached to the ball. The joystick also includes a first device held within the housing, and a second device held within the housing. The joystick also includes a first engagement shaft extending from the first device to the ball, the first engagement shaft having an end adjacent the ball and engaging the ball, and a second engagement shaft extending from the second device to the ball, the second engagement shaft having an end adjacent the ball and engaging the ball.

6 Claims, 7 Drawing Sheets

EXPLOSION PROOF ELECTRO-MECHANICAL JOYSTICK

BACKGROUND

This disclosure relates to an explosion proof electro-mechanical joystick for use in potentially explosive atmospheres such as underground coalmines.

Historically the controls used to tram or move crawler mounted underground mining equipment have consisted of either manually activated switches or multiple levers requiring a great amount of skill and experience to use efficiently. These complicated controls may also pose a safety concern when an operator has to react quickly. Some machines have incorporated intuitive, easy to use controls such as joysticks; however, most of these designs utilize intrinsically safe circuitry and vulnerable electronic components when exposed to the harsh conditions that can exist in a mine.

SUMMARY

The solution that has been defined in this disclosure is to create a user-friendly control system utilizing robust mechanical and electrical components in an explosion proof housing. More particularly, a mechanical, single lever, joystick is disclosed that can actuate two switches simultaneously where the switch axes of operation are not parallel; i.e. the joystick handle and ball intersect at some distance away from the switches.

Still more particularly, this disclosure defines a joystick comprising a housing, a ball supported and held within the housing, and a joystick handle attached to the ball. The joystick also includes a first device held within the housing, and a second device held within the housing. The joystick also includes a first engagement shaft extending from the first device to the ball, the first engagement shaft having an end adjacent the ball and engaging the ball, and a second engagement shaft extending from the second device to the ball, the second engagement shaft having an end adjacent the ball and engaging the ball.

This invention eliminates the need to use sensitive and vulnerable intrinsically safe electrical components to achieve an easy to use and intuitive control system. This design also has the potential to increase safety by giving the machine operators an intuitive control system. This may give the operator the ability to act more quickly in an emergency situation where every second counts. The joystick consists of an explosion proof housing that contains two rotary switches (or rheostats), an upper and lower socket that house the joystick ball, and engagement shafts that connect the switches to grooves in the joystick ball. The joystick is designed in such a way that when the joystick handle is moved straight forward, reverse or straight sideways, only one of the switches is activated. Any combination of forward or reverse and sideways movement will activate both switches.

This joystick allows for a much simpler and user-friendly control system for moving equipment in a potentially explosive environment. This system has the potential to be much more reliable compared to joysticks that utilize intrinsically safe circuitry and allows the flexibility to use various switches/rheostats without affecting legislative body approvals.

Figure 1:
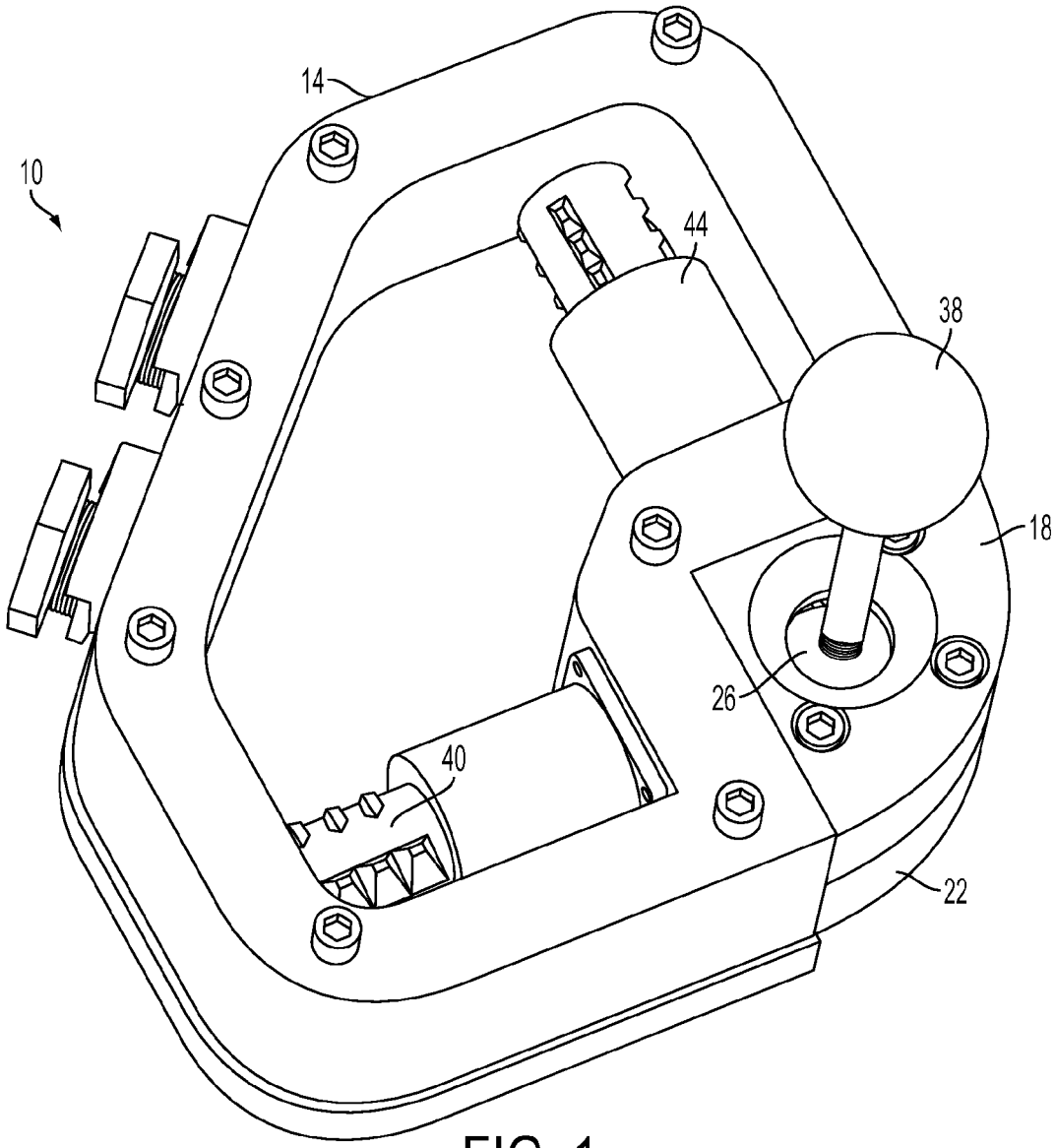
FIG. 1 is a perspective view of a joystick according to this disclosure with the top cover and dust protective boot omitted to clearly see what is inside.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 2:
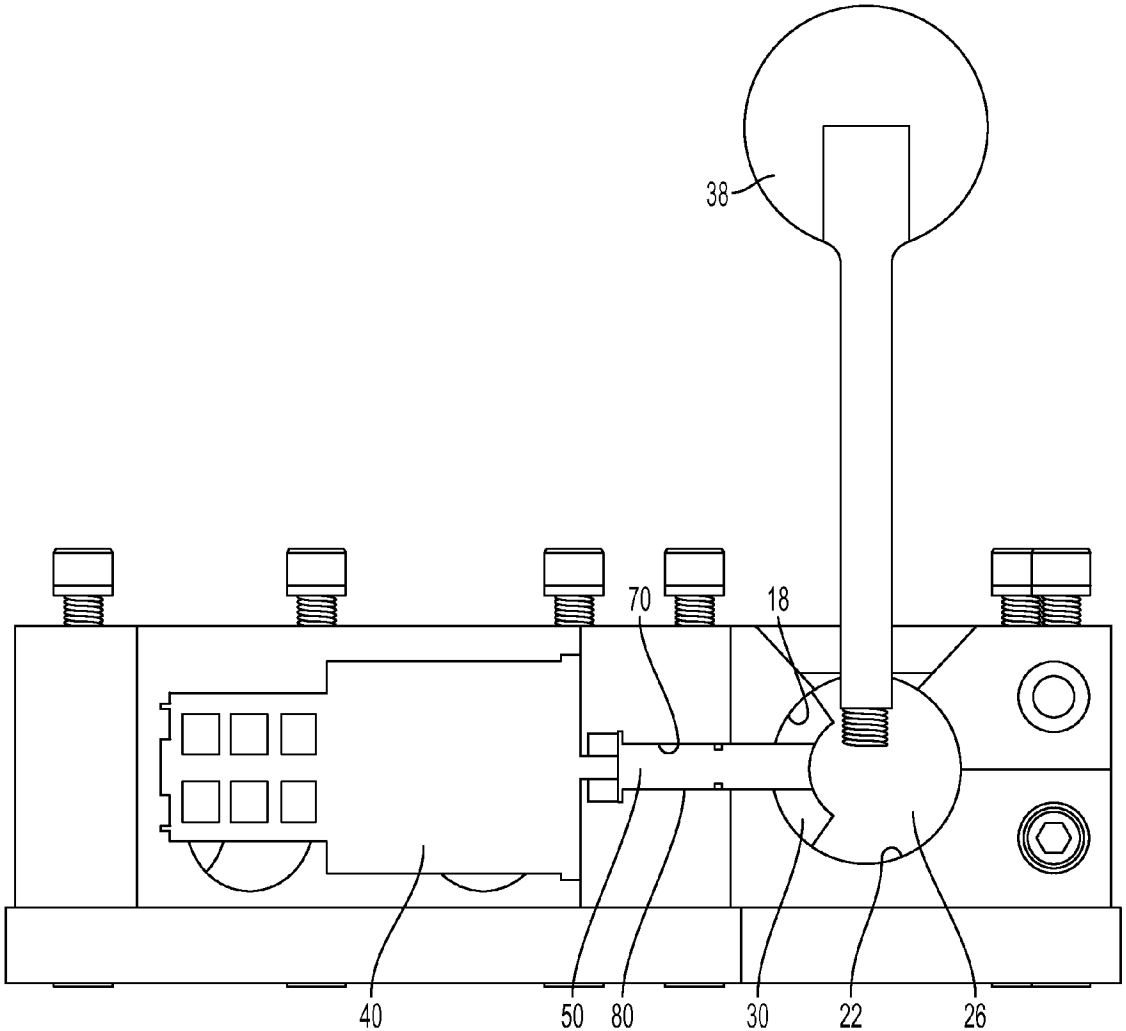
FIG. 2 is a side cross-section view of joystick shown in FIG. 1 through the centerline of the switch.
Figure 3:
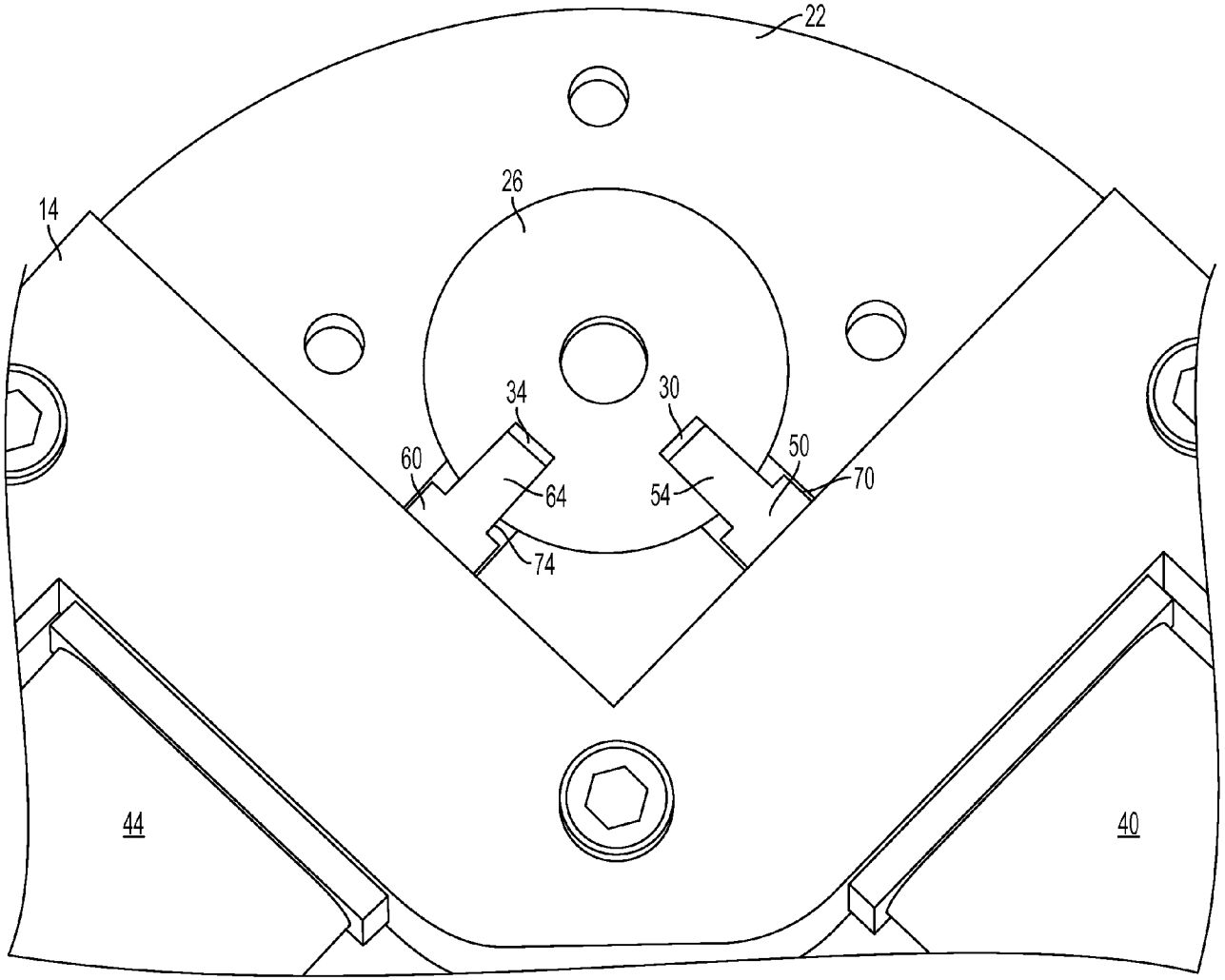
FIG. 3 is an enlarged top view of the arrangement of the ball, the shafts, and the socket shown in FIG. 1. The top socket and handle are omitted to better see the other parts.
Figure 4:
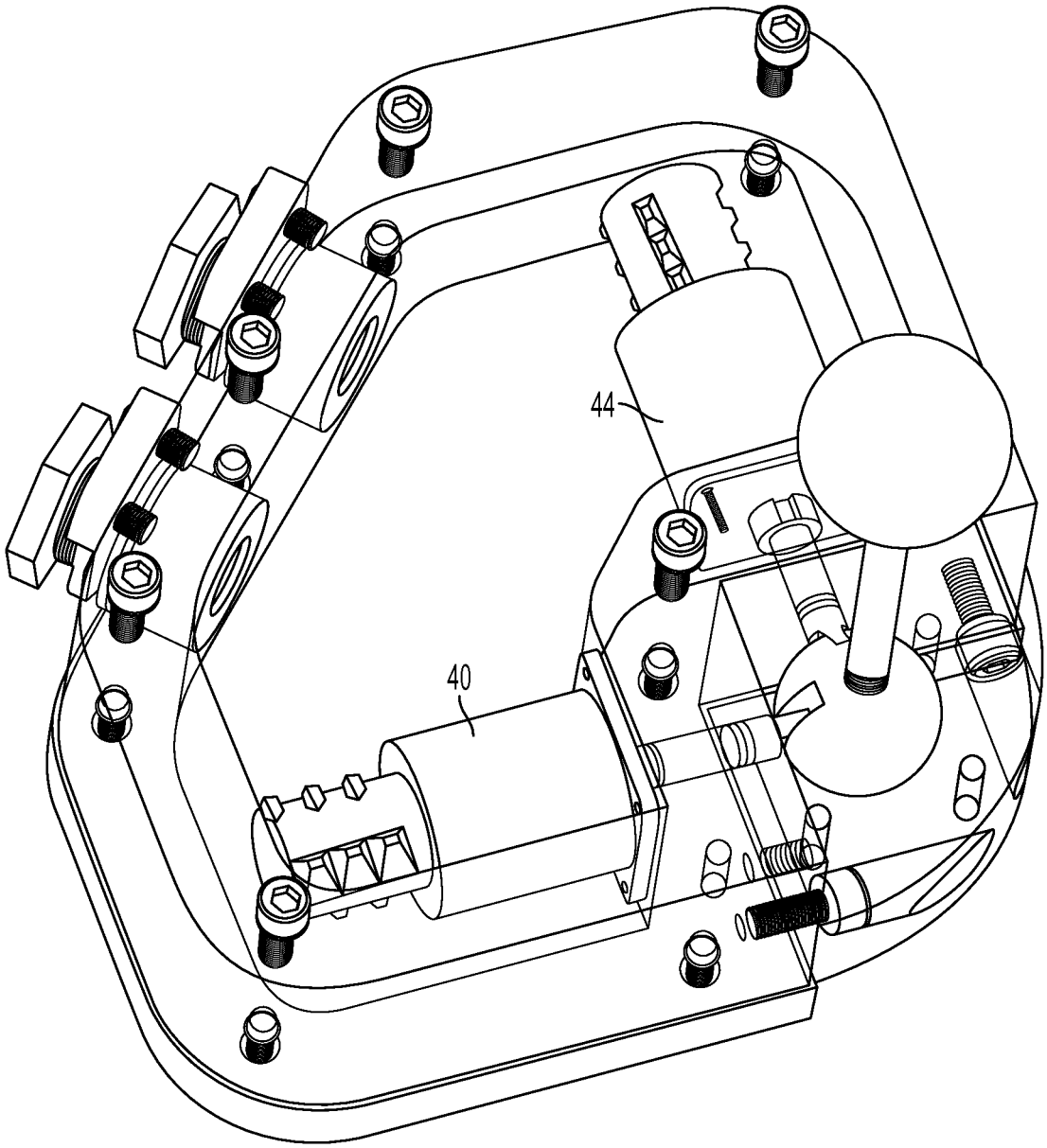
FIG. 4 is a perspective view of the joystick shown in FIG. 1 with the top socket omitted. The housing and bottom socket are transparent.
Figure 5:
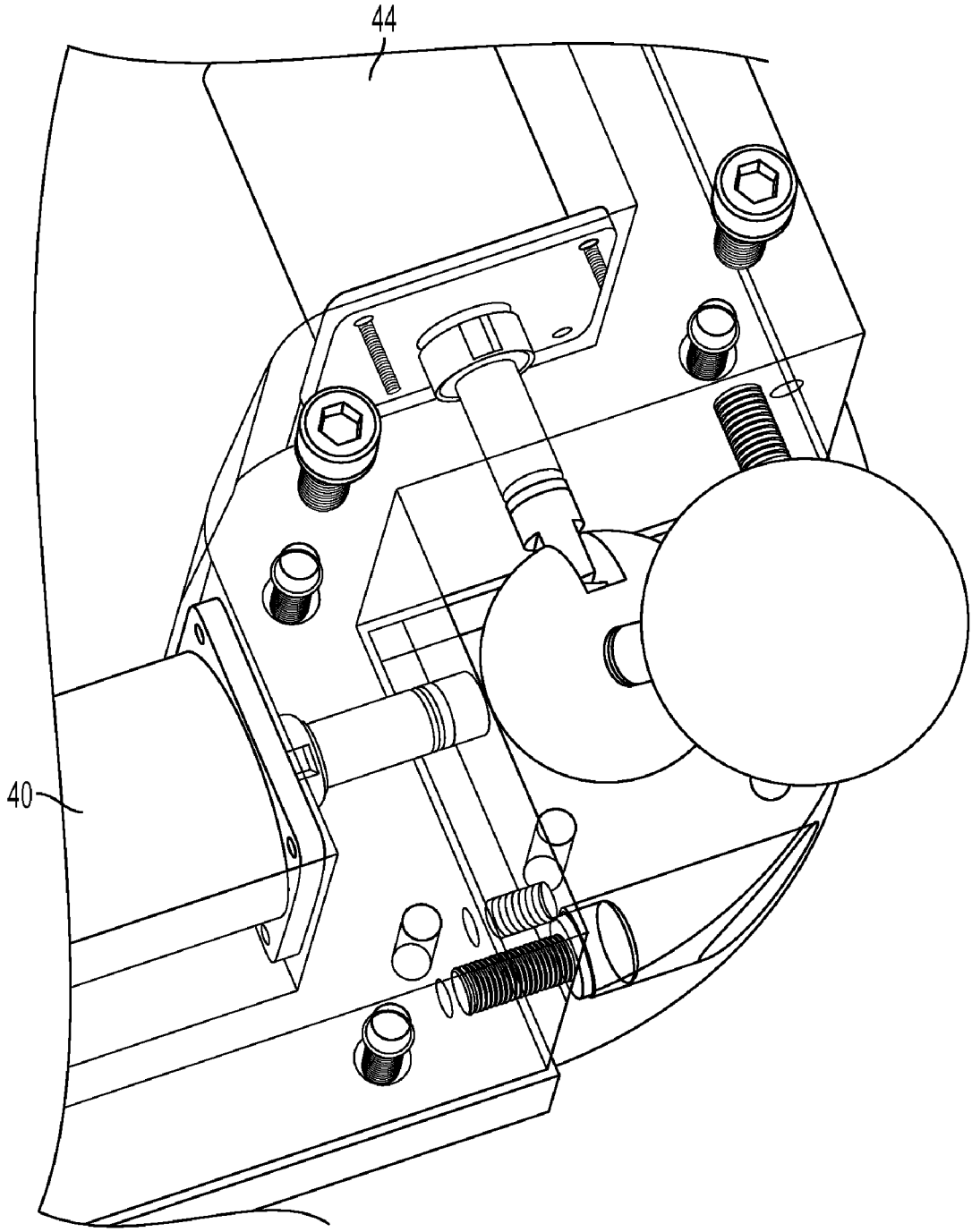
FIG. 5 is a perspective view of the joystick shown in FIG. 1 with the top socket omitted. The housing and bottom socket are transparent. This view shows the joystick handle being pushed in one direction, activating one switch.
Figure 6:
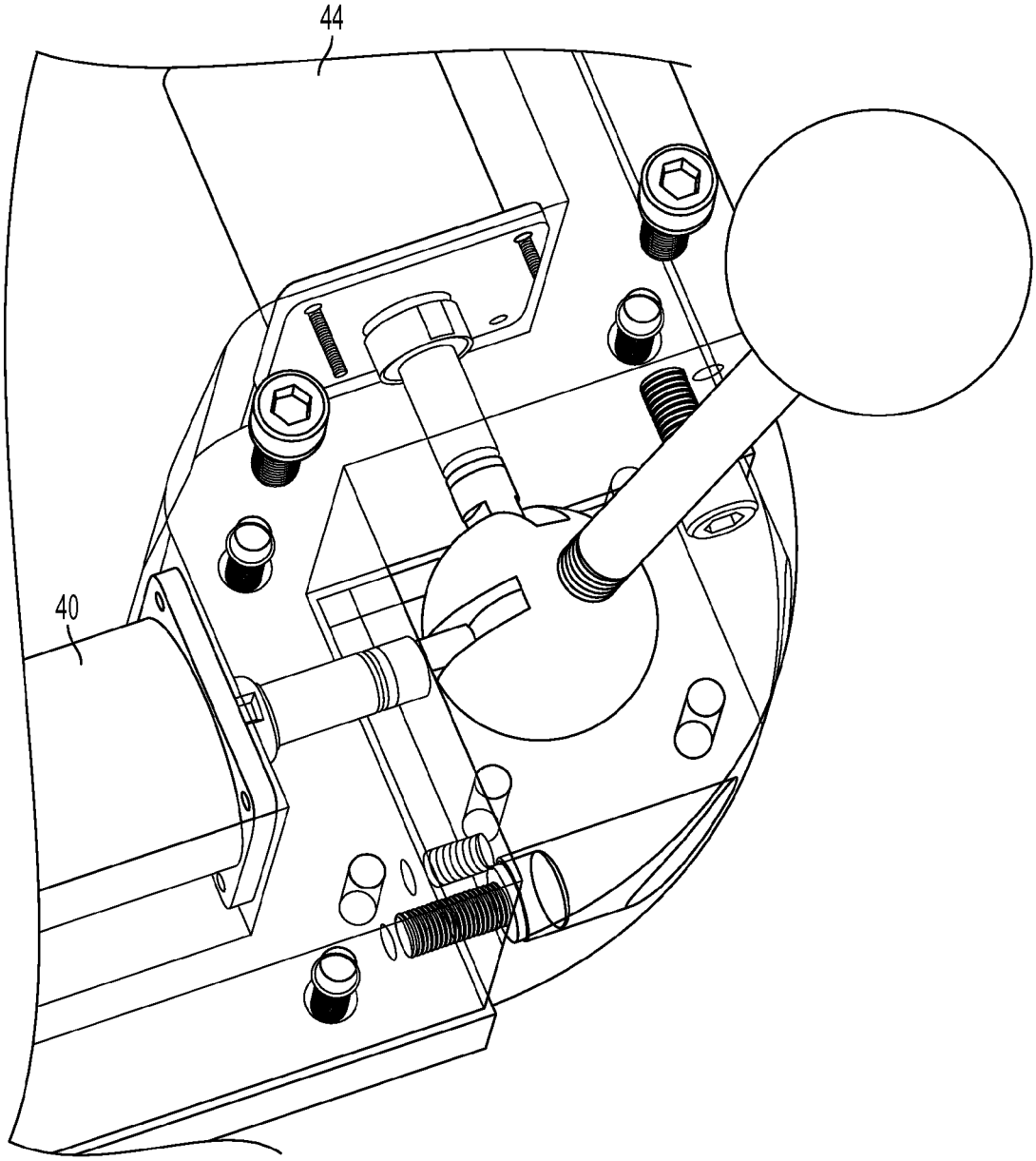
FIG. 6 is a perspective view of the joystick shown in FIG. 1 with the top socket omitted. The housing and bottom socket are transparent. This view shows the joystick handle being pushed in the opposite direction of FIG. 5, activating the other switch.
Figure 7:
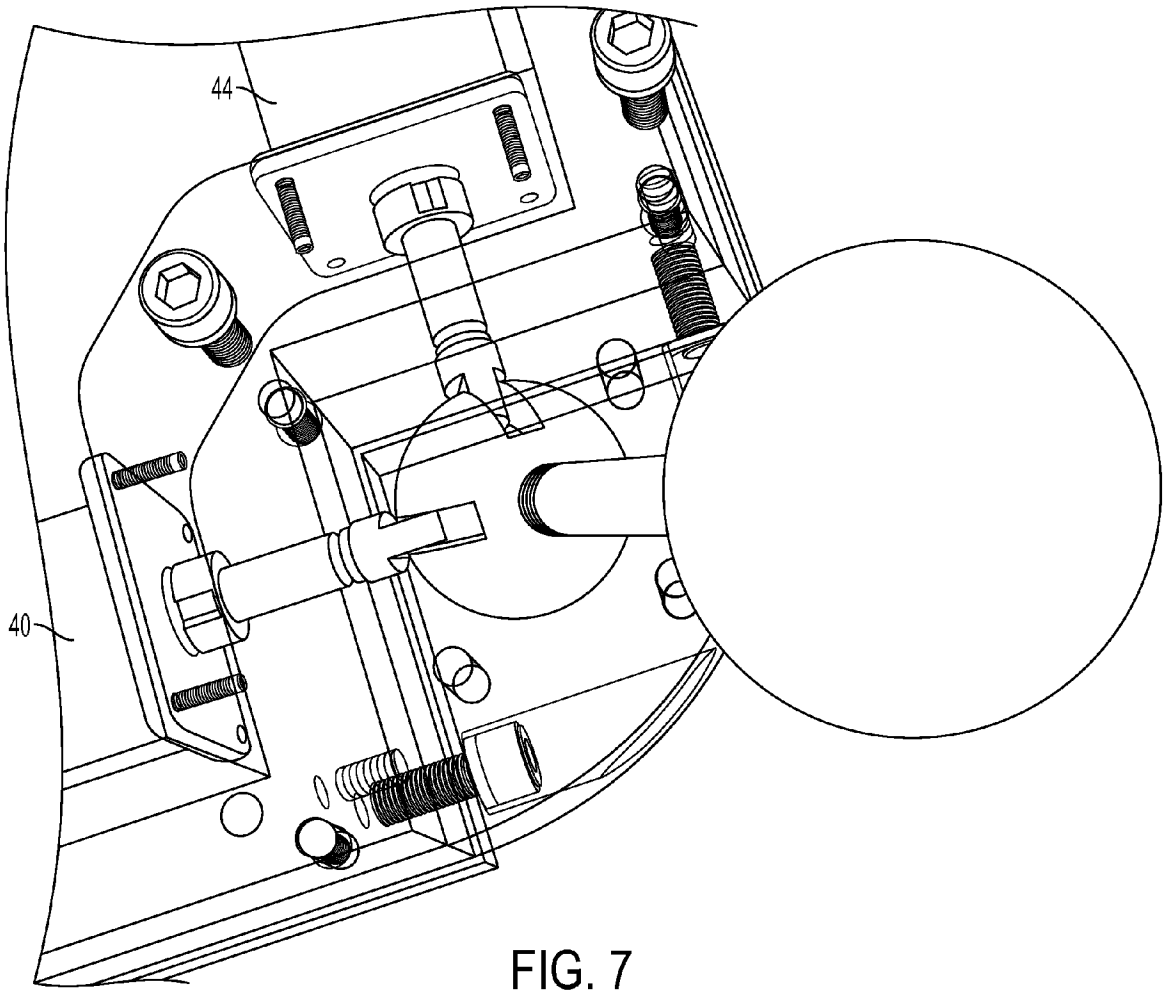
FIG. 7 is a perspective view of the joystick shown in FIG. 1 with the top socket omitted. The housing and bottom socket are transparent. This view shows the joystick handle being pushed at a 45-degree angle, activating both switches.

The joystick 10 outlined in this disclosure and illustrated in FIGS. 1 through 7 is made up of several key components. There is a main explosion proof housing 14 that contains all of the electrical components. Attached to this housing 14 is an upper socket 18 and a lower socket 22 (see FIG. 2), each with semi-spherical cut outs that house a joystick ball 26 and allow it to rotate. The upper socket 18 and lower or bottom socket 22 are held together by bolts. The joystick ball 26 is a sphere with two vertical indentations or slots 30 and 34.

More particularly, the ball 26 is supported and held within the housing 14, and the joystick 10 also includes a joystick handle 38 attached to the ball 26. The joystick 10 also includes a first device 40 held within the housing 14, and a second device 44 held within the housing 14. More particularly, the first device 40 is a first switch and the second device 44 is a second switch, but in other embodiments (not shown) other devices to be affected by movement of the joystick handle can be used. In addition, although only two switches are shown, additional switches at 90 degrees, or even more at 45 degrees, could be added to the joystick 10.

The joystick 10 also includes a first engagement shaft 50 extending from the first switch 40 to the ball 26, the first engagement shaft 50 having an end 54 received within the first slot 30 in the ball 26 and engaging the ball 26, and a second engagement shaft 60 extending from the second switch 44 to the ball 26, the second engagement shaft 60 having an end 64 received with the second slot 34 in the ball 26 and engaging the ball 26. Each slot defines a respective plane or flat surface that is in contact with its respective shaft end.

The first 50 and second 60 engagement shafts are perpendicular to each other, and the first 50 and second 60 engagement shafts pass through small clearance openings 70 and 74, respectively, in a portion 80 of the housing 14 that supports the ball 26. This keeps the interior of the housing 14 explosion proof because of the long flame path along the shafts and through the small clearance openings.

The flat surfaces of the ball 26 engage the flat surfaces on the ends of the shafts when the joystick handle 38 is moved in the appropriate direction. When the joystick handle 38 is moved in-line with the axis of one of these shafts, rather than turning the shaft, the slot in the ball 26 simply slides along the shaft. If the joystick handle 38 is moved in any direction other than directly in-line with the shafts axis, the shaft will rotate. If the joystick handle is pushed straight forward or reverse, only one of the switches is activated. If the joystick handle 38 is pushed straight to either side, then only the opposite switch activates. If the handle 38 is pushed in any other direction, then both switches are activated.

Various other features and advantages of the disclosure are apparent from the following claims.

The invention claimed is:

1. A joystick comprising a housing, a ball supported and held within said housing, a joystick handle attached to said ball, a first device held within said housing, a second device held within said housing, a first engagement shaft extending from said first device to said ball, said first engagement shaft having an end adjacent said ball and engaging said ball, and a second engagement shaft extending from said second device to said ball, said second engagement shaft having an end adjacent said ball and engaging said ball, wherein said first and second engagement shafts are perpendicular to each other, and wherein each of the first and second engagement shafts passes through a clearance opening extending from a portion of the respective first and second device through a portion of the housing that supports said ball.

2. A joystick in accordance with claim 1 wherein said ball has two indentations, with each indentation receiving an end of one of said engagement shafts.

3. A joystick in accordance with claim 2 wherein each of said ball indentations defines a respective plane.

4. A joystick in accordance with claim 1 wherein said first device is a first switch and wherein said second device is a second switch.

5. A joystick comprising a housing;

a ball supported and held within said housing;

a joystick handle attached to said ball;

a first device held within said housing;

a second device held within said housing;

a first engagement shaft extending from said first device to said ball, said first engagement shaft having an end adjacent said ball and engaging said ball; and a second engagement shaft extending from said second device to said ball, said second engagement shaft having an end adjacent said ball and engaging said ball, wherein said ball has two indentations, with each indentation receiving an end of one of said engagement shafts, and wherein each of the first and second engagement shafts passes through a clearance opening extending from a portion of the respective first and second device through a portion of the housing that supports said ball.

6. A joystick comprising a housing;

a ball supported and held within said housing;

a joystick handle attached to said ball;

a first switch held within said housing;

a second switch held within said housing;

a first engagement shaft extending from said first switch to said ball, said first engagement shaft having an end adjacent said ball and engaging said ball; and a second engagement shaft extending from said second switch to said ball, said second engagement shaft having an end adjacent said ball and engaging said ball, wherein each of the first and second engagement shafts passes through a clearance opening extending from a portion of the respective first and second switch through a portion of the housing that supports said ball.

* * * * *